United States Patent [19]

Saul et al.

[11] Patent Number: 5,072,169

[45] Date of Patent: Dec. 10, 1991

[54] RADIATION HARDENED POWER SUPPLIES FOR INTEGRATED CIRCUITS

[76] Inventors: Peter H. Saul, 51 Windsor Close, Towcester, Northants, NN12 7JB; Andrew K. Joy, 16 Willow Crescent, Great Houghton, Northampton, NN4 0AP, both of England

[21] Appl. No.: 664,946

[22] Filed: Mar. 5, 1991

[30] Foreign Application Priority Data

Mar. 6, 1990 [GB] United Kingdom ..... 9005049

[51] Int. Cl.[5] ..... G05F 1/56; G05F 1/613

[52] U.S. Cl. ..... 323/220; 323/221; 307/308

[58] Field of Search ..... 323/220, 222, 221, 902; 307/303, 303.1, 308, 311; 357/29–30

[56] References Cited

U.S. PATENT DOCUMENTS

| | | | |
|---|---|---|---|
| 3,679,963 | 7/1972 | Free et al. | 323/315 |
| 4,011,471 | 3/1977 | Rockett, Jr. | 307/308 |
| 4,323,846 | 4/1982 | Haraszti | 323/311 |
| 4,581,673 | 4/1986 | Pang | 307/318 |
| 4,948,989 | 8/1990 | Spratt | 307/318 |
| 4,952,522 | 8/1990 | Yamada et al. | 437/34 |

*Primary Examiner*—Peter S. Wong

*Attorney, Agent, or Firm*—Kirschstein, Ottinger, Israel & Schiffmiller

[57] ABSTRACT

A power supply for an integrated circuit chip, including supply regulation circuitry coupled between on-chip circuitry and a power supply connection, the supply regulation circuitry including a transistor having a diode coupled to the control electrode of the transistor, the diode having a relatively large diode junction area, and a resistor coupled in series with the main current path of the transistor having a relatively small or no diode junction area, whereby when the chip is subject to irradiation the diode means increases the conductivity of the main current path so that an increased voltage appears across the resistor thereby to reduce the supply voltage to the on-chip circuitry.

7 Claims, 1 Drawing Sheet

RADIATION HARDENED POWER SUPPLIES FOR INTEGRATED CIRCUITS

FIELD OF THE INVENTION

This invention relates to power supplies for Integrated Circuits.

BACKGROUND ART

There is a requirement in many military-specified devices for power supply provisions to integrated circuits which operate in such a way as to rapidly reduce the power supply voltage to the chip so that the phenomenon of "latch-up" can not occur. The reason for this is that, under radiation conditions, very large "photo" currents can flow in the junctions of the integrated circuits such that parasitic transistors in the structure are turned on and large currents can flow, potentially destroying the device through power from its own supplies. Such photocurrents are only predictable to a limited extent, and it must be assumed that all junctions are capable of passing large reverse currents and that transistor action during these conditions is severely impaired. This means that circuits which operate during the time of radiation must do so independently of their normal parameters.

One means of radiation hardening is to minimise the number of junctions present, and this is done using oxide isolation, in various schemes already in production. However, junctions must exist for conventional device operation, and so must be protected.

In conventional integrated circuits, the resistors are as vulnerable as the transistors to photocurrents, since they have at least one large junction to substrate, and in some cases further junctions to the surrounding material. Since the resistor is often larger than the accompanying transistors, it may be more susceptible to radiation.

SUMMARY OF THE INVENTION

It is an object of the invention to provide a power supply for an integrated circuit which rapidly reduces the power supply voltage to the chip when the chip is subject to irradiation.

The present invention is based on the consideration that an integrated circuit chip commonly includes a power supply regulator coupled between the external power source and the chip circuitry for regulating the voltage and current to the chip circuitry. The concept of the invention is to couple a diode circuit element having a relatively large diode junction area to a base electrode or other control electrode of a transistor in the regulator, and to connect in the main current path of the transistor a resistor which does not have a diode junction with the chip substrate, or alternatively possesses diode junctions of insignificant chip substrate area.

Thus in accordance with the invention, when the chip is subject to irradiation, the relatively large area diode generates a large photoelectric current which is injected into the base of the transistor within the regulator thereby increasing the conductivity of the main current path in the transistor. However, this increased conductivity will create increased current flow through the resistor, which, since it has little or no diode junction area will not be subject to photoelectric currents and therefore will stay at roughly the same value, whereby the increased current flow through the transistor will create an increased voltage drop across the resistor, such that the voltage supply to the chip circuitry is reduced in accordance with the amount of irradiation of the chip.

IC processes in current use feature polysilicon resistors deposited at a late stage of the process, on top of the oxide insulation layer and therefore do not include diode junctions with the underlying substrate along their length, only connecting to transistors at one end. As an alternative, metallic thin film resistors could be deposited on top of the chip which similarly do not have significant diode junction surface area. It would also be possible to employ resistors external to the chip for example thick film resistors, which would not have any significant diode junction area except at the point of electrical contact.

Accordingly the present invention provides a power supply for an integrated circuit chip, including supply regulation means coupled between on-chip circuitry and a power supply connection, the supply regulation means including a transistor having a diode means coupled to the control electrode of the transistor, the diode means having a relatively large diode junction area, and a resistor means coupled in series with the main current path of the transistor having a relatively small or no diode junction area, whereby when the chip is subject to irradiation the diode means increases the conductivity of the main current path so that an increased voltage appears across the resistor thereby to reduce the supply voltage to the on-chip circuitry.

BRIEF DESCRIPTION OF THE DRAWINGS

A preferred embodiment will now be described with reference to the accompanying single figure of drawings, which is a circuit diagram of a power supply for an integrated circuit chip in accordance with the invention.

DETAILED DESCRIPTION OF DRAWINGS

Figure 1:
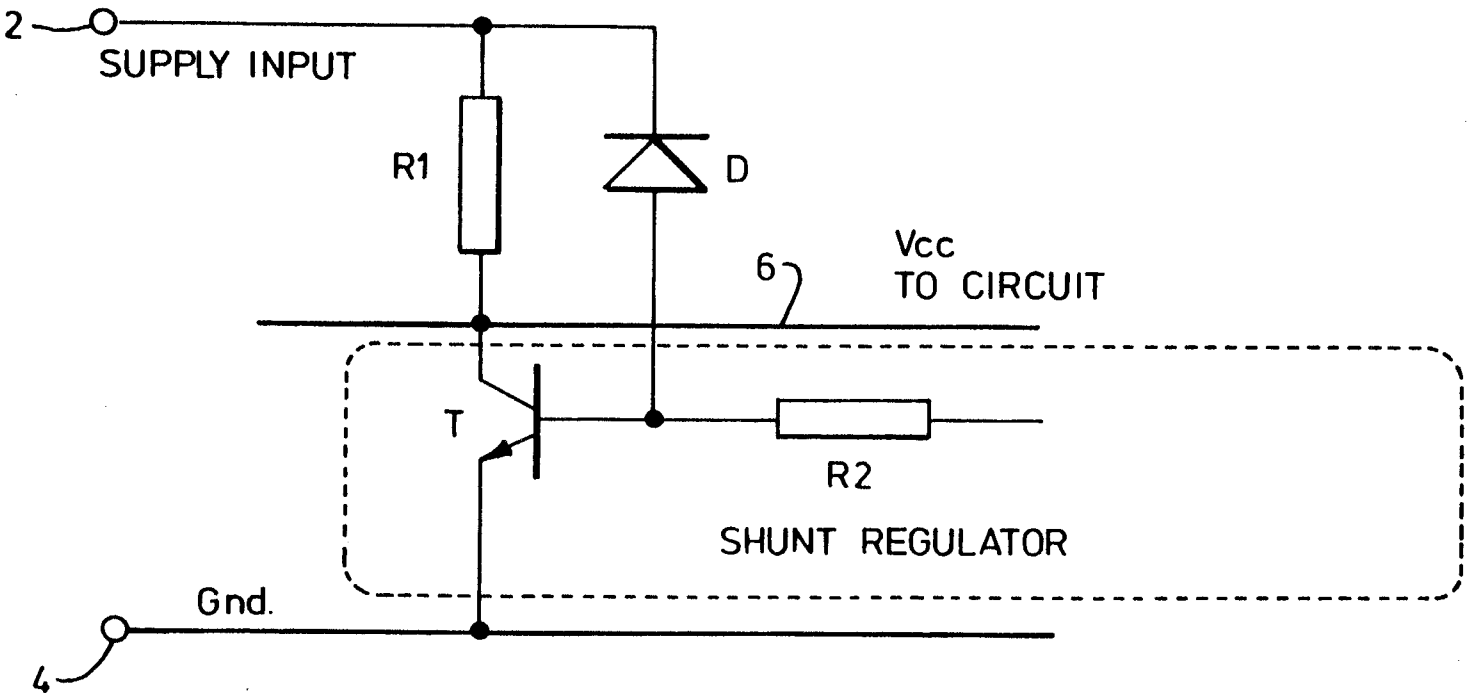

Referring to the drawing, the circuitry shown is formed on an integrated circuit chip and includes a supply input contact pad 2 for coupling an external power source, a ground reference connection contact pad 4, a shunt regulator circuit including a transistor T, wherein the collector of transistor T provides a voltage $V_{CC}$ to the on-chip circuitry via line 6. The collector of transistor T is coupled to the supply input 2 by way of a resistor R1 which is a polysilicon resistor deposited on top of an oxide isolation layer and therefore having a diode junction area with the chip substrate only at the connection point with the collector of the transistor. A diode D is coupled between supply input 2 and the base of transistor T and has a relatively large junction area with the substrate in comparison with that of resistor R1 and also in comparison with the surface areas of the various diodes present within the on-chip circuitry (not shown). A resistor R2 is provided coupled to the base of transistor T and this provides the control current to the transistor T in normal operation, when it operates in a common emitter mode to supply voltage $V_{CC}$.

New IC processes feature polysilicon resistors which are deposited at a late stage of the process, on top of the oxide isolation layer. They therefore do not include junctions along their length to the surrounding material, and need in the limit only connect to transistors etc. at one end. With appropriate layout, the remote end of a resistor need not have a junction to substrate. This leads to the circuit of FIG. 1. Power is supplied to the chip at a voltage above that required through a series resistor on the chip. The actual supply voltage to the circuitry is at the conventional voltage for the logic family in use. The supply on the chip is regulated by a "shunt" or parallel regulator; although unusual, this is a known technique. The shunt regulator may take any of several forms, but the output stage has a large area transistor T which passes excess current from the supply, producing the appropriate voltage drop across R1. The base of the transistor T is fed through a resistor R2. A large area diode D is included in the circuit; this normally passes no current at all.

In the event of a burst of radiation incident on the chip, photocurrent is passed through D, appearing as base current in T. This turns rapidly on, pulling voltage V to a low level. Considering the transistor T, excess photocurrents will only enhance the operation described above. Resistor R1 can only pass current in the normal way; little excess current is expected, so the voltage drop is further increased. In the circuit itself, excess currents will start to flow, but will further increase the voltage drop across R1. The circuit is therefore protected against the effects of the radiation burst by the rapid fall in power supply voltage. Any tendency of parts of the circuit to pass excessive currents just cause a further fall in supply to the circuit. The voltage to which the supply falls is unpredictable, but self limiting by the mechanism described.

The resistor R2 is included to ensure that previous stages in the shunt regulator can not turn the transistor T1 off.

The diode D is desirably large so that significant photocurrent is passed, and the power supply voltage reduced, under radiation conditions below that considered critical, i.e. before transistor action becomes severely abnormal.

All the components described are assumed to be on a single chip; in a system, each chip could economically be protected in this way. Alternatively, any or all of D, T, R1 and R2 could be discrete components.

The circuit described is a bipolar technology one; very similar techniques could be arranged for CMOS.

Whilst a shunt power supply regulator is described, other regulators could be employed for example a series regulator having a transistor operating in common base mode, in situations where the excess current flowing in the larger than normal transistor does not adversely affect the operation of the on-chip circuitry.

We claim:

1. A power supply for an integrated circuit chip, including supply regulation means coupled between on-chip circuitry and a power supply connection, the supply regulation means including a transistor having a diode means coupled to the control electrode of the transistor, the diode means having a relatively large diode junction area, and a resistor means coupled in series with the main current path of the transistor having a relatively small or no diode junction area, whereby when the chip is subject to irradiation the diode means increases the conductivity of the main current path so that an increased voltage appears across the resistor thereby to reduce the supply voltage to the on-chip circuitry.

2. A power supply as claimed in claim 1 wherein the supply regulator means is a shunt regulator, wherein said transistor is connected in common emitter mode between the power supply connection and ground reference.

3. A power supply as claimed in claim 1 wherein the supply regulation means is incorporated in the integrated circuit chip.

4. A power supply as claimed in claim 1 wherein said diode means is incorporated in the integrated circuit chip.

5. A power supply as claimed in claim 1 wherein said resistor is incorporated in the integrated circuit chip.

6. A power supply as claimed in claim 1 wherein the resistor is a polysilicon resistor deposited on top of an oxide isolation layer.

7. A power supply as claimed in claim 1 wherein the diode junction area of the diode means is large in comparison to the diode junction areas of the individual circuit components of the on-chip circuitry.

* * * * *